US006696229B1

(12) United States Patent
Dukler et al.

(10) Patent No.: US 6,696,229 B1
(45) Date of Patent: Feb. 24, 2004

(54) DRY PHOTOGRAPHIC PRINTING PROCESS

(75) Inventors: Shlomo Dukler, Tel Aviv (IL); Jacob Hassan, Hod Hasharon (IL); Yaron Meerfeld, Ramat Chen (IL)

(73) Assignee: Kromotek, Ltd. (IL)

( * ) Notice: Subject to any disclaimer, the term of this patent is extended or adjusted under 35 U.S.C. 154(b) by 0 days.

(21) Appl. No.: 10/030,443

(22) PCT Filed: Jul. 6, 2000

(86) PCT No.: PCT/IL00/00397

§ 371 (c)(1),
(2), (4) Date: Jul. 15, 2002

(87) PCT Pub. No.: WO01/04702

PCT Pub. Date: Jan. 18, 2001

(30) Foreign Application Priority Data

Jul. 8, 1999 (IL) ..... 130857
Feb. 21, 2000 (IL) ..... 134655

(51) Int. Cl.[7] ..... G03C 7/46; G03C 1/73; G03C 1/685

(52) U.S. Cl. ..... 430/333; 430/337; 430/363; 430/962

(58) Field of Search ..... 430/333, 337, 430/363, 962

(56) References Cited

U.S. PATENT DOCUMENTS 3,293,055 A 12/1966 Baum
3,320,067 A 5/1967 Tylor
3,341,330 A 9/1967 Foris
3,346,385 A 10/1967 Foris
3,364,023 A 1/1968 Becker et al.
4,770,978 A * 9/1988 Matsuzaka et al. ..... 430/363
4,845,021 A * 7/1989 Miyazaki et al. ..... 430/962
5,053,320 A * 10/1991 Robillard ..... 430/962
5,451,490 A * 9/1995 Budz et al. ..... 430/363
6,355,393 B1 * 3/2002 Hirai et al. ..... 430/363

FOREIGN PATENT DOCUMENTS

| | | |
|---|---|---|
| EP | 0 657 773 A1 | 6/1995 |
| FR | 2352321 | 4/1976 |
| GB | 1 236 423 | 6/1971 |
| JP | 61203450 | 9/1986 |
| WO | 97/44196 | 11/1997 |

OTHER PUBLICATIONS

Baccon et al., "*Synthesis and spectrokinetic properties of a series of indolinic and benzothiazolinic spiropyrans for the purpose of applications in the filed of reprographics*", Unitersite de Bretagne Occidentale, Organic Synthesis Laboratory and Universite de Paris VII, Physical Organic Chemistry Laboratory, 1979.

Hinnen et al., "*No. 291—Photochromism of indolinospiropyrans*", Doctorate of Physical Sciences thesis, Faculty of Sciences of Strasbourg University, Apr. 1967.

(List continued on next page.)

*Primary Examiner*—Richard L. Schilling
(74) *Attorney, Agent, or Firm*—Altera Law Group LLC

(57) ABSTRACT

Photographic process, in which a substrate comprising a plurality of superimposed layers of photochromic materials sensitive to different light wavelengths is provided. The object to be photographed is scanned and a digital file defining the image of the object is generated from the scanning. A plurality of sources of laser light having different wavelengths, each of which is the wavelength to which one of the photochromic materials is sensitive is provided and the layers of photochromic materials are irradiated by means of the laser beams produced by the sources, according to a program determined by the digital file, whereby to develop in each pixel of the substrate the color that it has in the image. The colors thus generated in the pixels of the substrate layers; and the background areas of the substrate layers are set.

15 Claims, 2 Drawing Sheets

OTHER PUBLICATIONS

Guglielmetti et al., "*No. 505—Synthesis of a series of benzothiazolic spiropyrans*", Department of Organic Chemistry, Faculty of Sciences of the University of Marseilles, 1967.

Orlovic et al., "*Photochromic Spiropyran Resists", J. Electrochem. Soc.: Electrochemical Technology*, Oct. 1969, pp. 1464–1469.

Kryszewski et al., "*Effects of Photoselection on the Kinetics of Colour Decay in a Photochromic Spiropyran/Poly* (*alkyl methacrylate*) *Matrix", Makromol. Chem, 183*, pp. 1257–1262.

Smets et al., "*Photomechanical Effects in Photochromic Systems", Pure & Appl. Chem.*, vol. 50, pp. 845–856.

Gardlund et al., "*Photoalkylmethacrylate Films as Matrices for Photochromic Studies", J. Polym. Sci., B7*,1969, vol. 7, pp. 719–725.

XP 002150074/JP, 59215382, Dec. 5, 1984, Japan.

XP 002150073/JP, 07228048, Aug. 29, 1995, Japan.

* cited by examiner

LASER PHOTOCHROMIC PRINTER

DRY PHOTOGRAPHIC PRINTING PROCESS

FIELD OF THE INVENTION

This invention relates to a dry photographic printing process, based on the use of photochromic materials, which permits to obtain high quality photographs by means of conventional electronic equipment. The invention is also applicable to the reproduction of color prints.

BACKGROUND OF THE INVENTION

Photochromic materials, viz. materials which are colorless, but develop colors when irradiated with light of specific wavelength, have been known in the art for a long time. Each photochromic material is sensitive only to a given light wavelength and will not acquire color if it is irradiated with light of a different wavelength.

The light sensitivity of photochromic materials has led to new types of self-developing and dry photography, which are known in the literature for more than 20 years. They are used as color-forming components in photochromic and free radicals, photographic materials with a sensitivity of 10-4 $j.cm^{-2}$(see Photochronism, R. C. Bertelson, Willy Interscience New York, Ed C. H. Brown (1971) and A. L. Kartuzhaqnsi (Ed), Non-silver photographic processes, Izd. Khimiya, Leningrad 1984).

The photochromic materials are also used in the technology of photomasking and photoresist (see P. L. Foris (N.C.R.), U.S. Pat. No. 3,346,385, 1967, and M. Orlovoic, E. Stone and J. M. Pearson, J. Electrochem. Soc., 116 (1969), p. 1464).

Many applications in the field of imaging and reprography systems have been suggested using metal salts and different supports or reactants.

A record sheet for thermographic copying or hot stylus recording has a coating consisting of an intimate Ore of solid calcium resinate and 4',7',8'-trimethoxy-BIPS. These react upon melting to give a stable, deep blue color, and various colors can be obtained from other combinations of cations and spiropyrans (see H. H. Baum, U.S. Pat. No. 3,293,055, 1966; L.D. Taylor, Polaroid, U.S. Pat. No. 3,320,067, "Composition and process utilizing photospirans", 1967; P. L. Foris, U.S. Pat. No. 3,341,330,"Methods of forming thermally stable photochromic dyes and products", 1967; W. J. Becker and P. L. Foris, U.S. Pat. No. 3,364,023, 1968).

The influence of a polymer on the characteristics of the photochromic transformation, and the possibility of stabilizig the colored form by selecting the appropriate polymer or the type of chemical binding of the spiropyran to the latter, are discussed by M. Kryszenski, B. Vadovski and R. IuhoLf, Macromol. Chem., 183 (1982), p. 1257; G. Smets, J. Brackem and M. Iril, Pure Appl. Chem., 50 (1978), p. 1979; and M. Le Baccon, F. Garnier and R. Guglielmetti, Bull. Soc. Chim. Fr. (1979), p. 315.

When paper or plastic materials containing a spiropyran are irradiated through a negative transparent original, colorless spiropyrans is transformed, in the region exposed to ultraviolet radiation, into colored photomerocyanine set in this form by the vinylic polymer of binder. This process yields a negative image of the original (see Z. G. Gardlund and J. J. Laverty, J. Polym. Sci., B 7(1969), p. 719; and C. Ceintrey, R. Guglielmetti and M. Le Baccon, French Patent Application No. 76.15336, 1976).

As is well known, different colors may be obtained by additive synthesis or subtractive synthesis, which are both conventionally used, e.g. in color printing. This invention will be described as based on additive synthesis, but subtractive synthesis is not excluded. Further, the colors used for the synthesis could be the basic colors—magenta, yellow and cyan—or the complementary colors—respectively green, red and blue—or, in particular cases, other combinations of colors. In describing this invention, it will be assumed that complementary colors (briefly, the RGB system) are used, but this is not to be construed as a limitation. Any method or procedure known in the art for the production of desired colors by additive or substractive synthesis can be used in carrying this invention into practice.

Despite the extensive knowledge of photochromic materials which is available in the art, no satisfactory photographic process based on their use has been developed so far.

It is the purpose of this invention to provide such a process for dry printing and photography.

It is an another purpose to provide such a process that produces stable prints.

It is a further purpose to provide such a process that produces high quality photographs.

It is a still further purpose to provide such a process that can be carried out by using conventional electronic equipment.

It is a still further purpose to provide such a process that can be used for the reproduction of printed color images.

It is a still further purpose to provide personalized printing, in which changes in a part or all of the output can be effected as a function of a predetermined rule, to prevent counterfeiting.

SUMMARY OF THE INVENTION

The process of color photography or reproduction of color prints according to the invention comprises the steps of:

a—providing a substrate having at least three and preferably four superimposed layers, including photochromic materials sensitive to light wavelengths different from layer to layer;

b—scanning the object to be photographed or reproduced;

c—generating from the scanning a digital file defining the image of the object, to be created on the photograph or reproduced;

d—providing at least three and preferably four sources of laser light having different wavelengths, each of which is the wavelength to which one of said photochromic materials is sensitive, while the other photochromic materials are not sensitive to it; and e—irradiating the substrate by means of the laser beams produced by said sources, according to a program determined by said digital file, whereby to develop in each pixel of the substrate the color that it has in said image.

Any substrate layer that is not irradiated or is irradiated with a light wavelength to which the color of the layer is not is sensitive, is unaffected and if or where transparent, it remains transparent. In the following description, it will be assumed that the RGB system is used and therefore the aforesaid substrate layers include photochromic materials which, when irradiated by the appropriate light wavelength, will produce in each layer one of the aforesaid complementary colors: red, green and blue, and optionally, in one layer, black. However, this is not intended to be a limitation, and, for example, the basic colors magenta, yellow and cyan might be produced.

The digital file, defining the image, may be obtained by scanning the object to be photographed, viz. by scanning in vivo. Thus, e.g., a digital file representing the face of a person can be obtained by scanning said face. This technique and the scanner apparatus for carrying it out are well known. The results of the scanning is a file which determines the color of each pixel of the photograph. If the invention is used for reproducing a color print, the color print will be scanned.

Once the digital file has been created, the laser beam sources are controlled by it, to develop the appropriate color in each pixel of the substrate by generating and directing onto said pixel the laser beam the wavelength of which sensitizes the photochromic material which, when sensitized, assumes said appropriate color. Though black is not properly a color, what is said herein about the colors applies to it as well. In other words, the digital file will control the laser sources in such a way that if a given color is desired to be developed at a given pixel, it will activate the laser beam that develops said color when impinging on one of the layers of the substrate including a photochromic material (hereinafter, briefly, "a photochromic layer"). If the photochromic layer which develops said color is not the top one, the laser beam will cross the superimposed layers without affecting them in any way, because the photochromic materials of said superimposed layers are not sensitive to the wavelength of said beam and therefore said layers will be and remain transparent. It will be understood that, when reference is made to a pixel of the substrate, the pixel is defined in the layer that is developed. In correspondence to said pixel, the superimposed layers are unaffected by the radiation.

The additive synthesis is due to the fact that if the pixels are sufficiently small, the human eye combines the colors of adjacent pixels. The subtractive synthesis requires a white background, from which one or more basic or complementary colors are filtered out, as well known in the art.

If a less than perfect image is considered satisfactory, less than three complementary colors can be used, in a way that is well known to persons skilled in the color printing. In particular cases, different combinations of colors can be used in the photochromic layers of the substrate, or a different background layer can be provided, in ways that will be apparent to persons skilled in the art. Also, an uppermost transparent and colorless layer can be added to protect the image.

The size of the pixels is a relevant parameter and is decided according to the particular use of the invention and for the particular degree of resolution desired. For instance, if it is desired to produce a large image that will be seen only from a distance, the pixels can be much larger than for an ordinary photograph.

If it should be desired to carry out the invention using a subtractive synthesis, a white background will be provided in the bottom layer of the substrate and the various photochromic layers will be so irradiated as to subtract from the white the colors complementary to the color that should be developed in each particular pixel.

In a preferred form of the invention, the printing process further comprises setting the color developed by irradiation in each pixel of the substrate layers; and setting the background of each of said substrate layers—viz. the areas developed of the substrate layers in which no color has been developed by irradiation. By the expression "setting the background" is meant herein rendering the color or lack of color or transparency of said non-irradiated areas, viz. of all the pixels thereof, so that a color or a different color may not be developed therein, or more precisely in the photochromic materials included therein, by accidental irradiation or irradiation applied for another purpose. Hereinafter, the expression "setting the color" of a pixel or area should be construed as meaning rendering its chromatic condition permanent, whether said chromatic condition should consist in the presence or in the absence of a color or in a state of lack of color and transparence.

Means for setting a photochromic material and rendering its color or absence of color stable and affected by irradiation of any wavelength, are known in the art. One means is the application of heat. The application of heat may be associated with an irradiation. Other means consist in modifications of the molecule of said material by chemical means, and are described e.g. in M. Kryszenski et al., Macromol. Chem. 183 (19820 1257); G. Smets et al., Pure Appl. Chem., 50 (1978) 1979; M. Le Baccon et al., Bull. Soc. Chim. France, 8 (1979) 315, A. Hinnen et al., Bull. Soc. Chim. France 8 (1968) 2066, and R. Guglielmetti et al., Bull. Soc. Chim. France 8 (1967) 1967 2824.

Therefore, the preferred form of the photographic printing of this invention, comprises the steps of:

a—providing a substrate having at least three and preferably four superimposed layers, including photochromic materials sensitive to light wavelengths different from layer to layer;

b—scanning the object to be photographed or reproduced;

c—generating from the scanning a digital file defining the image of said object, to be created on the photograph or reproduced;

d—providing at least three and preferably four sources of laser light having different wavelengths, each of which is the wavelength to which one of said photochromic materials is sensitive, while the other photochromic materials are not sensitive to it;

e—irradiating the substrate by means of the laser beams produced by said sources, according to a program determined by said digital file, whereby to develop in each pixel of the substrate the color that it has in said image;

f—setting the colors thus generated in the pixels of the substrate layers; and g—setting the background areas of the substrate layers.

The various steps set forth hereinbefore need not be separate ones carried in the order in which they have been listed. For example, an irradiation and a setting step may be carried out concurrently.

The settings may be carried out in various cases by heating alone or by irradiation alone or by a combination of heating and irradiation of said substrate layers.

DETAILED DESCRIPTION OF PREFERRED EMBODIMENTS

Figure 1:
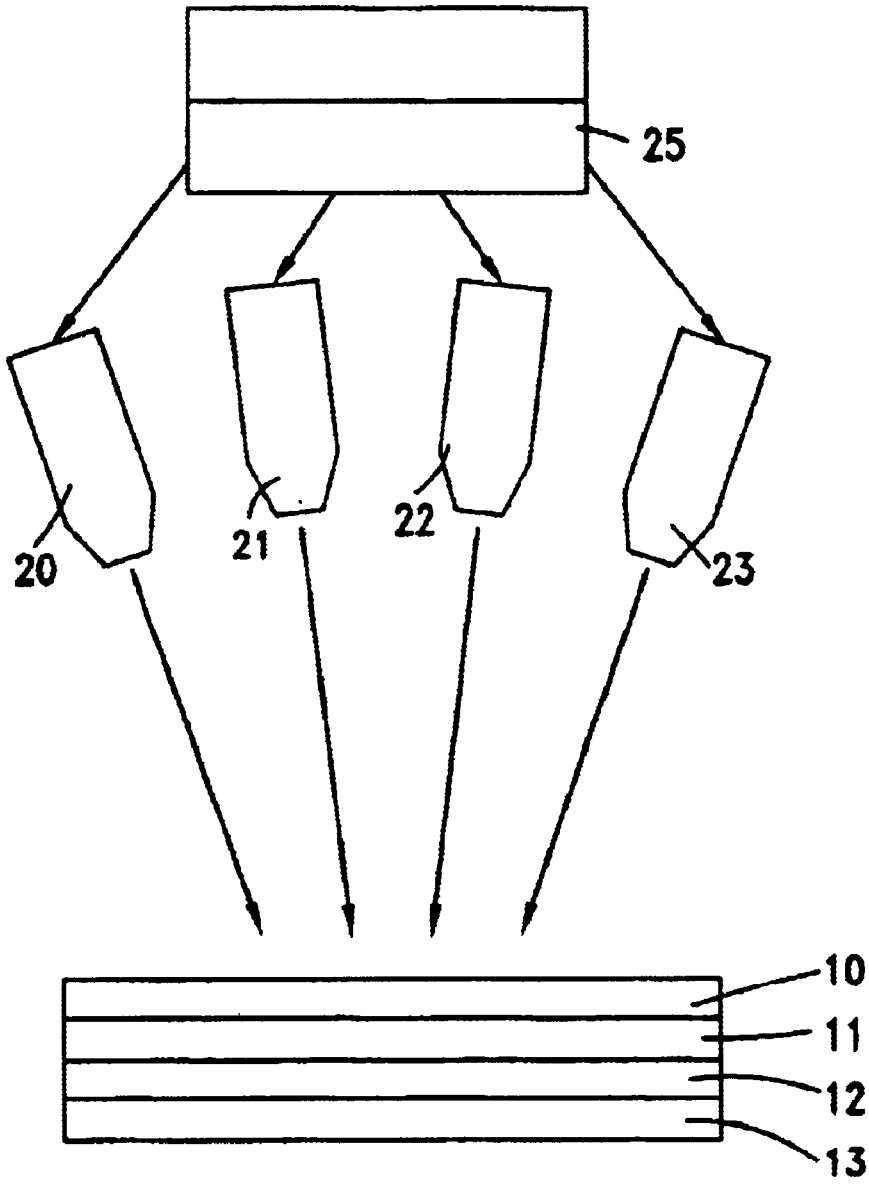
FIG. 1 is a schematic representation of stages of the process preceding the setting stages, according to an embodiment of the invention.

In the schematic representation of FIG. 1, numerals 10, 11, 12 and 13 indicate four layers containing photochromic materials. Numerals 20, 21, 22 and 23 indicate laser generators. Laser generator 20, 21, 22 and 23 produces laser beams having the wavelength that sensitizes the photochromic materials of layers 10, 11, 12 and 13, respectively. Controller 25, which is a microcomputer containing a digital file obtained from scanning the object to be photographed, controls the laser generators so that each of their beams impinges on the pixels of the substrate in which the respective color is to be developed. Though four photochromic layers and correspondingly four laser generators are illustrated, a smaller number of layers and generators, e.g. three, could be used.

As has been said, the substrate comprises a plurality of layers, each including a photochromic dye, which layers are connected in any suitable way so that the substrate can be handled as a unitary body. Preferably, each layer contains the appropriate photochromic material retained in a polymeric film container of any convenient polymer. Said container is constituted by two walls of film between which the photochromic material is housed, and therefore it constitutes a bag-like structure adapted to contain the photochromic dye. The several film containers are connected to one another by any suitable means, such as adhesive means, to constitute the unitary substrate. A backing or support sheet of any convenient kind, not illustrated, could also be provided.

The photochromic materials, contained in the aforesaid layers, are preferably chosen from spyropyrans and photomerocyanine including:

a—the indoline series;

b—the benzoindoline series;

c—oxazolidine compounds; and d—thiazolidine and isothiazolidine compounds.

For the thermodegradation:

e—γ-oxo-benzodithiole merocyanine;

f—α-oxo-azahetrocyle merocyanine; and g—the spirooxazines series.

The apparatus for scanning the image to be reproduced, whether in vivo or in a print, are those already used in color printing and photography and need not be described in particular.

The controller is a conventional microprocessor, that is programmed to control the laser generators according to the digital file inserted in it. Such programming involves no difficulty and can readily be accomplished by a skilled programmer.

Figure 2:
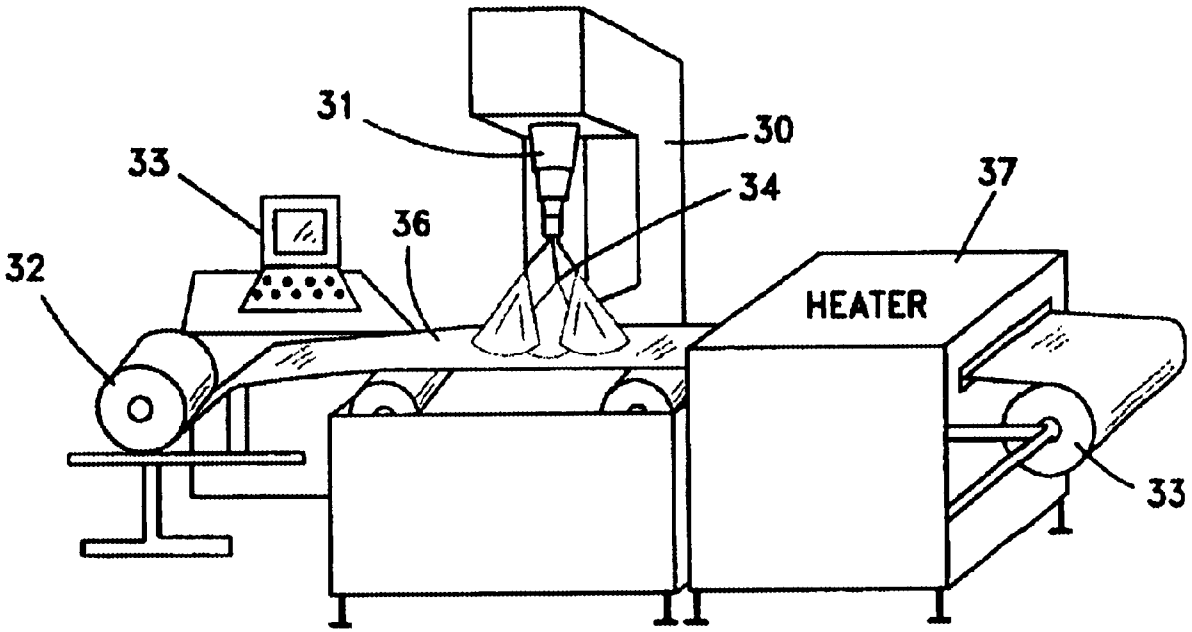
FIG. 2 is a perspective view of an apparatus for carrying out an embodiment of the invention.

FIG. 2 show in perspective view a printer for carrying out an embodiment of the invention. Column 30 supports laser generators 31, which, in this embodiment, are in the number of three. Correspondingly, three photochromic layers, each comprising a polymeric film container filled with photochromic dye, are rolled together to from a cylindrical supply 32, conveniently supported, from which they are unrolled by being drawn by a drum 33. The superimposed photochromic layers indicated together at 36, pass through a radiation zone under generators 31, being preferably supported in said zone by a plate not visible in the figure. Numeral 34 symbolically indicates the three laser beams. Microprocessor 35 controls the process. Numeral 37 indicates a heater, which can be used to set the colors of the print, viz. of the irradiated pixels of each substrate layer, and to set the colors of the backgrounds, viz. of the non-irradiated pixels of each substrate layer, according to an embodiment of the invention.

A non-limitative example of the process of the invention will now be given, with reference to the following chemical scheme.

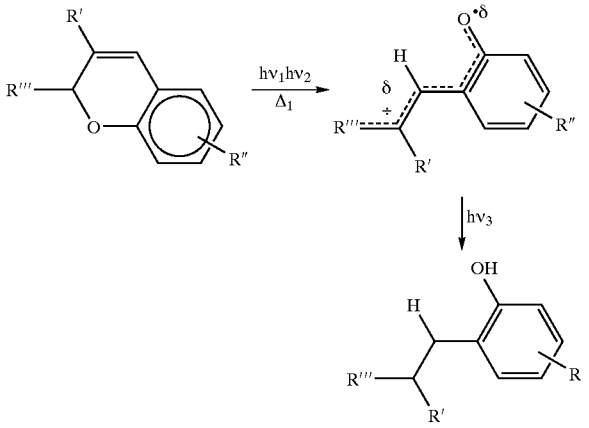

$hv_L$, $hv_2$ and $hv_3$ indicate irradiations of wavelengths preferably from 360 to 700 nm. Δt indicates a stage of heating preferably at temperatures from 60 to 150° C. The first step indicated hereinbefore generates an ephemeral intermediate compound. The second step generates the final, stabilized compound. In this particular example, the Anal, stabilized molecule has a red color, but this, of course, is merely an example, and the invention may be applied to obtain any final color. The said color is stabilized in the second step by an irradiation and is not erasable below 80° C. Heating or infrared irradiation may be employed, in some cases, in said second step as well.

In this example, the substituents of tie above formula may have the following meanings:

$R^{111}$=thiazolidine; -1,3-oxazolidine; pyrolidine; 1,3 oxazine; piperidine; phenanthridine; acridine; quinoline; indoline; benzoselenazoline; dithiole; perfluorocyclopentene $R^1$=$CH_3$, $CH_3O$, acetoxy $R^{11}$=$CH_3$—; $CH_3CH_2$—; $CH_3CH_2$—O While embodiments of the invention have been described by way of example, it will be apparent that the invention can be carried into practice with many modifications, variations and adaptations, without departing from its spirit or exceeding the scope of the claims.

What is claimed is:

1. Photographic process, which comprises the steps of:

a—providing a substrate comprising a plurality of superimposed layers of photochromic materials sensitive to different light wavelengths;

b—scanning the object to be photographed;

c—generating from the scanning a digital file defining the image of said object;

d—providing a plurality of sources of laser light having different wavelengths, each of which is the wavelength to which one of said photochromic materials is sensitive; and e—irradiating said layers of photochromic materials by means of the laser beams produced by said sources, according to a program determined by said digital file, whereby to develop in each pixel of the substrate the color that it has in said image.

2. Process according to claim 1, further comprising setting the colors thus generated in the pixels of the substrate layers; and setting the background areas of the substrate layers.

3. Process according to claim 1 or 2, wherein the substrate has at least three superimposed layers and wherein at least three sources of laser light having different wavelengths, one for each substrate layer, are provided.

4. Process according to any one of claims 1 to 3, for reproducing color prints.

5. Process according to claim 1, wherein the substrate layers include photochromic materials which, when irradiated by the appropriate light wavelength, produce in each layer one of the complementary colors: red, green and blue.

6. Process according to claim 1, wherein the substrate layers include photochromic materials which, when irradiated by the appropriate light wavelength, produce in each layer one of the basic colors: magenta, yellow and cyan.

7. Process according to claim 1, wherein the program determined by the digital file controls the laser sources in such a way that the appropriate color is developed in each pixel of the substrate by generating and directing onto said pixel the laser beam the wavelength of which sensitizes the photochromic material which, when sensitized, assumes said appropriate color.

8. Photographic process for obtaining photographs of less than perfect quality, which comprises the steps of claim 1, but wherein however less than three complementary or basic colors are used.

9. Process according to claim 1, wherein the substrate comprises an uppermost transparent and colorless layer.

10. Process according to claim 1, wherein each of the superimposed layers is constituted by a polymeric film container housing the appropriate photochromic material.

11. Process according to claim 1, wherein the photochromic materials are chosen from among spyropyrans and photomerocyanine.

12. Process according to claim 1, wherein the photochromic materials are chosen from among:

a—the indoline series;

b—the benzoindoline series;

c—oxazolidine compounds;

d—thiazolidine and isothiazolidine compounds.

e—γ-oxo-benzodithiole merocyanine;

f—α-oxo- azahetrocyle merocyanine;

g—the spirooxazines series.

13. Process according to claim 2, wherein at least one of the setting steps is carried out by the application of heat.

14. Process according to claim 2, wherein at least one of the setting steps is carried out by the combined application of irradiation and heat.

15. Process according to claim 2, wherein at least one of the setting steps is carried out by irradiation only.

* * * * *